US005590957A

United States Patent [19]

Chen

[11] Patent Number: 5,590,957

[45] Date of Patent: Jan. 7, 1997

[54] LAMP SUPPORT ASSEMBLY

[76] Inventor: Franks Chen, 8F-6, 100, Sec. 2, Hoping E. Rd.,, Taipei, Taiwan

[21] Appl. No.: 496,296

[22] Filed: Jun. 29, 1995

[51] Int. Cl.[6] ..... F21M 3/18

[52] U.S. Cl. ..... 362/419; 362/427

[58] Field of Search ..... 362/419, 427, 362/428, 401

[56] References Cited

U.S. PATENT DOCUMENTS

| | | | |
|---|---|---|---|
| 3,188,460 | 6/1965 | Thorsen et al. | 362/401 |
| 3,239,184 | 3/1966 | Kirkeby | 362/401 |
| 4,165,530 | 8/1979 | Sowden | 362/401 |
| 5,097,400 | 3/1992 | Cvek | 362/419 |
| 5,101,332 | 3/1992 | Hsia | 362/401 |
| 5,333,103 | 7/1994 | Cvek | 362/419 |

*Primary Examiner*—Denise L. Gromada
*Assistant Examiner*—Alfred Basichas

[57] ABSTRACT

A lamp support assembly including a mounting base for mounting on a lamp stand, a lamp holder to hold a lampshade, a central housing, a first cap and a second cap secured to two opposite ends of a coupling hole on the mounting base by a first screw rod and a first nut, a third cap and a fourth cap secured to two opposite ends of central housing by a second screw rod and a second nut, a first metal tube connected between the first cap and the third cap, a second metal tube connected between the second cap and the fourth cap, a first coupling and a second coupling mounted around the second screw rod and connected to the central housing at two opposite ends, a fifth cap and a sixth cap secured to two opposite ends of a coupling hole on the lamp holder by a third screw rod and a third nut, a third metal tube and a fourth metal tube respectively connected between the fifth and sixth caps and the first and second caps, and an electric wire inserted through the mounting base, the first cap, the first metal tube, the third cap, the central housing, the third metal tube, the fifth cap, into the lamp holder, and then connected to the lamp in the lampshade through an ON/OFF switch on the lamp holder.

4 Claims, 3 Drawing Sheets

LAMP SUPPORT ASSEMBLY

BACKGROUND OF THE INVENTION

The present invention relates to desk lamps, and relates more particularly to a lamp support assembly for desk lamps which holds the electric wire on the inside and, which can be conveniently adjusted to the desired angular position.

A variety of desk lamps have been disclosed, and have appeared on the market. Conventional desk lamps are commonly comprised of an upright post supported on a base to hold a lampshade and a lamp bulb (lamp tube) in the lampshade. These desk lamps have been gradually abandoned because the lamp bulb (lamp tube) cannot be adjusted to the desired angle or elevation. Nowadays, adjustable desk lamps have been intensively used. These adjustable desk lamps are commonly comprised of an adjustable supporting frame assembly having a mounting base at one end for fastening to a stand and a lamp holder at an opposite end for holding a lampshade and a lamp bulb (lamp tube) inside the lampshade. When installed, the electric wire is mounted around the adjustable supporting frame assembly on the outside. The adjustable supporting frame assembly can be adjusted vertically as well as horizontally. However, because the adjustable supporting frame assembly is comprised of two metal frame units pivotably connected together, the electric wire tends to be jammed in the connectors between the two frame units when the adjustable supporting frame assembly is adjusted, causing an electric leakage. In order to prevent an electric shock, a transformer may be installed to drop DC 110V/220V to 12V for transmitting to the lamp bulb (lamp tube) through the adjustable supporting frame assembly. However, the installation of the transformer greatly increases the weight and manufacturing cost of the adjustable supporting frame assembly.

SUMMARY OF THE INVENTION

The present invention has been accomplished to provide a lamp support assembly which eliminates the aforesaid problem by holding the electric wire on the inside of the lamp support assembly. According to the preferred embodiment of the present invention, the lamp support assembly comprises a mounting base for mounting on a lamp stand, a lamp holder to hold a lampshade, a central housing, a first cap and a second cap secured to two opposite ends of a coupling hole on the mounting base by a first screw rod and a first nut, a third cap and a fourth cap secured to two opposite ends of central housing by a second screw rod and a second nut, a first metal tube connected between the first cap and the third cap, a second metal tube connected between the second cap and the fourth cap, a first coupling and a second coupling mounted around the second screw rod and connected to the central housing at two opposite ends, a fifth cap and a six cap secured to two opposite ends of a coupling hole on the lamp holder by a third screw rod and a third nut, a third metal tube and a fourth metal tube respectively connected between the fifth and six caps and the first and second caps, and an electric wire inserted through the mounting base, the first cap, the first metal tube, the third cap, the central housing, the third metal tube, the fifth cap, into the lamp holder, and then connected to the lamp in the lampshade through an ON/OFF switch on the lamp holder.

DETAILED DESCRIPTION OF THE PREFERRED EMBODIMENT

Figure 1:
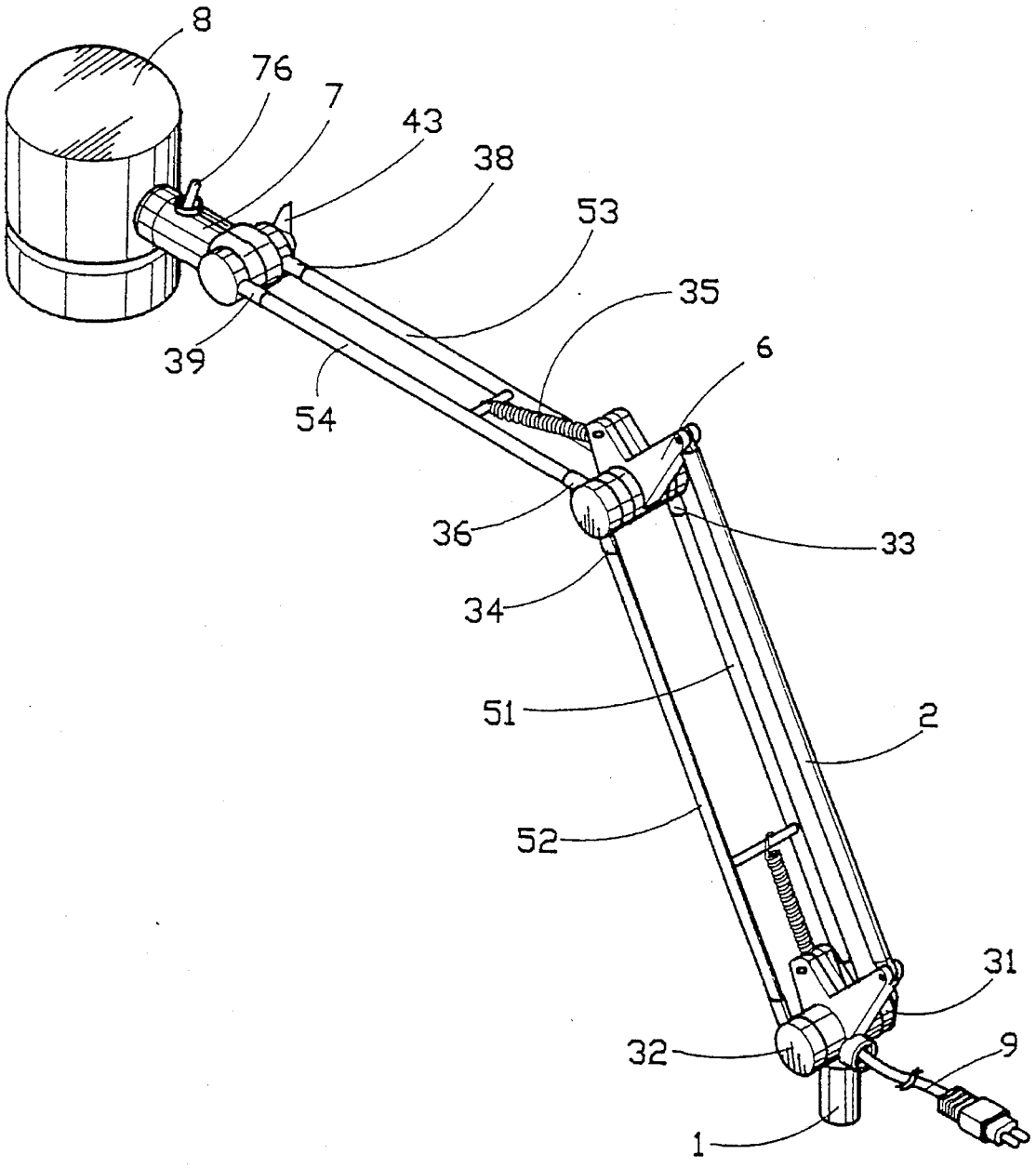
FIG. 1 is an elevational view of a lamp support assembly according to the present invention.
Figure 2:
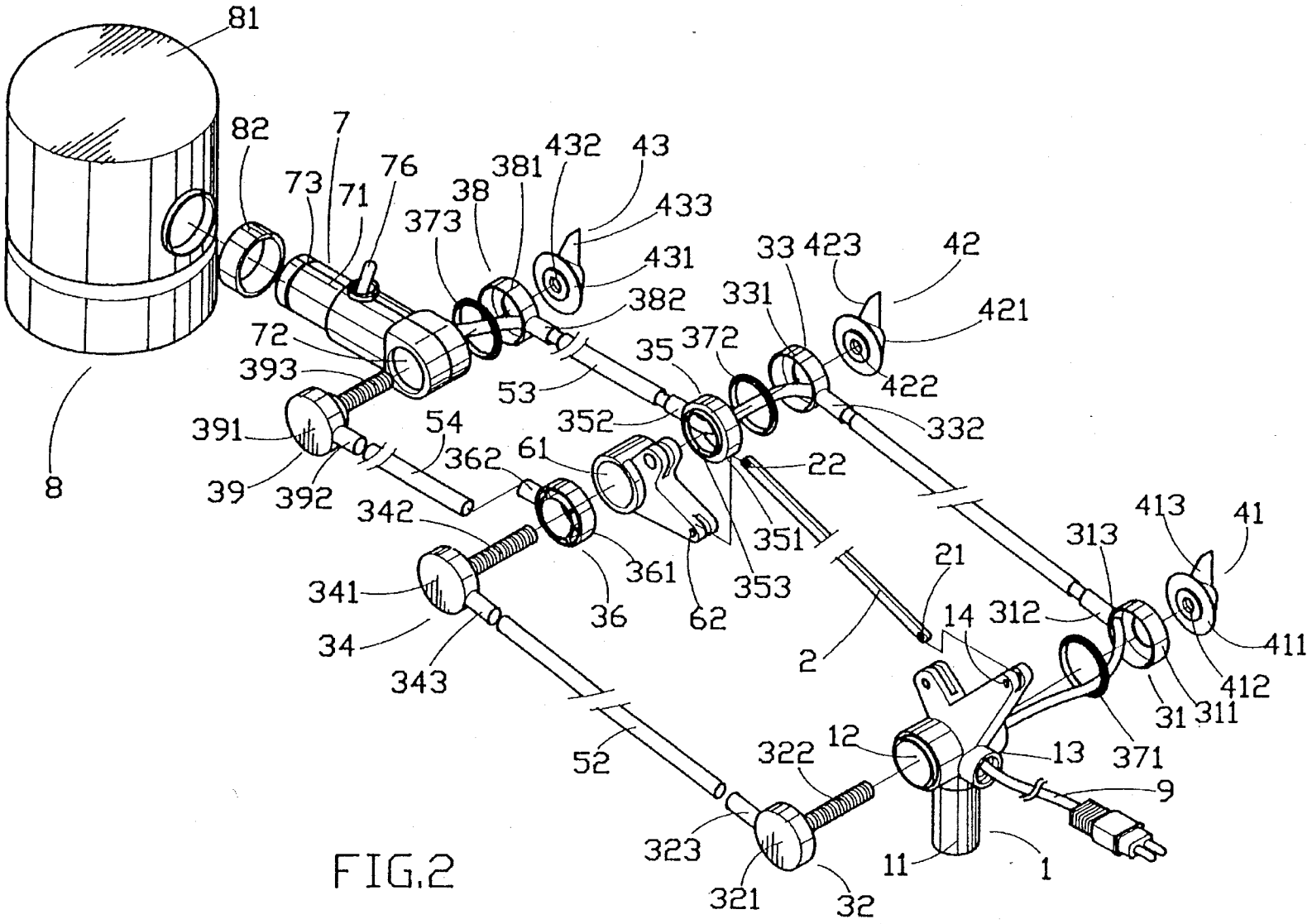
FIG. 2 is an exploded view of the lamp support assembly shown in FIG. 1.
Figure 3:
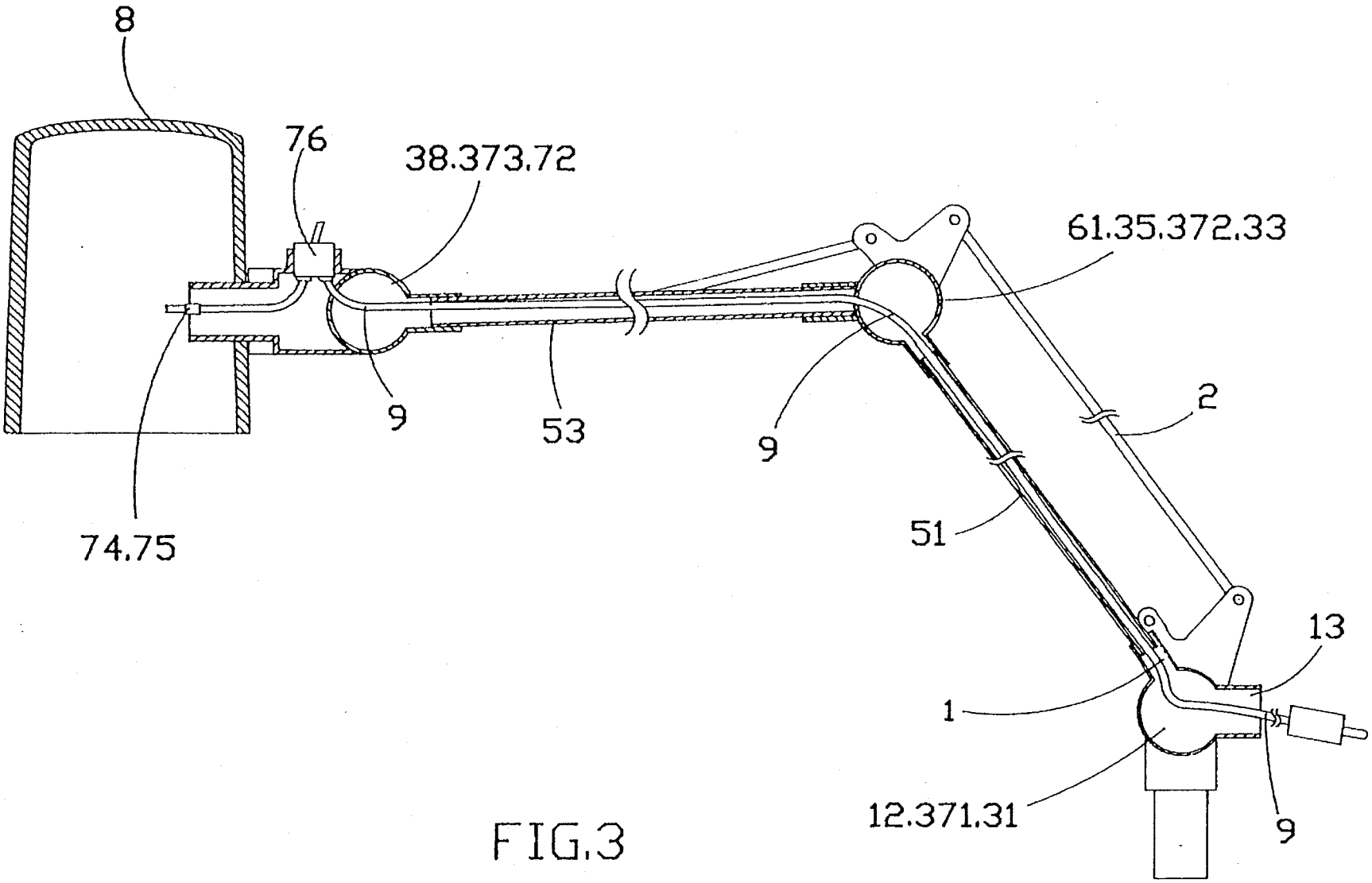
FIG. 3 is a longitudinal view in section of FIG. 1.

Referring to FIGS. 1, 2, and 3, the lamp support assembly in accordance with the present invention is generally comprised of a mounting base 1, a first cap 31, a second cap 32, a first adjusting screw nut 41, a first metal tube 51, a second metal tube 52, a third cap 33, a fourth cap 34, a central housing 6, a first coupling 35, a second coupling 36, a second adjusting screw nut 42, a link 2, a third metal tube 53, a fourth metal tube 54, a fifth cap 38, a sixth cap 39, a lamp holder 7, a third adjusting screw nut 43, a lampshade 8, and a two-line electric wire 9.

The mounting base 1 comprises a tubular plug rod 11 vertically disposed at the bottom for connection to a stand or mounting assembly (not shown), a coupling hole 12 transversely disposed in the middle, a wire hole 13 communicated with the coupling hole 12, and a lug 14 at the top.

The first cap 31 comprises an annular cap body 311 covered on the coupling hole 12 at one end, a coupling stub tube 312 radially extended from the cap body 311, and a wire hole 313 through the periphery of the cap body 311 in communication with the inside of coupling stub tube 312.

The second cap 32 comprises a solid cap body 321 covered on the coupling hole 12 at one end remote from the first cap 31, a screw rod 322 perpendicularly extended from the center of the cap body 321 and inserted through the coupling hole 12 and the first cap 31 and then screwed up with the first adjusting screw nut 41, and a coupling stub tube 323 radially extended from the cap body 321.

The first adjusting screw nut 41 comprises a body 411 having a center screw hole 412 screwed up with the screw rod 322 of the second cap 32 to hold down the first cap 31, and a finger strip 413 for turning the body 411 on the screw rod 322.

The first metal tube 51 has one end coupled to the coupling stub tube 312 of the first cap 31 and an opposite end coupled to the third cap 33.

The second metal tube 52 has one end coupled to the coupling stub tube 323 of the second cap 32 and an opposite end coupled to the fourth cap 34.

The central housing 6 comprises a transverse coupling hole 61 and a lug 62.

The link 2 has a first pivot hole 21 at one end pivotably connected to the lug 14 on the mounting base 1 by a pivot (not shown), and a second pivot hole 22 at an opposite end pivotably connected to the lug 62 on the central housing 6 by a pivot (not shown).

The third cap 33 comprises an annular cap body 331 covered on the coupling hole 61 at one end, a coupling stub tube 332 radially extended from the cap body 331 and coupled to one end of the first metal tube 51, and a wire hole (not shown) through the periphery of the cap body 331 in communication with the inside of coupling stub tube 332.

The fourth cap 34 comprises a solid cap body 341 covered on the coupling hole 61 of the central housing 6 at one end remote from the third cap 33, a screw rod 342 perpendicularly extended from the center of the cap body 341 and inserted through the coupling hole 61 and the third cap 33 and then screwed up with the second adjusting screw nut 42, and a coupling stub tube 343 radially extended from the cap body 341 and coupled to one end of the second metal tube 52 opposite to the second cap 32.

The second adjusting screw nut 42 comprises a body 421 having a center screw hole 422 screwed up with the screw rod 342 of the fourth cap 34 to hold down the third cap 33, and a finger strip 423 for turning the body 421 on the screw rod 342.

The first coupling 35 comprises a coupling ring 351 mounted around the screw rod 342 of the fourth cap 34 and retained between the central housing 6 and the third cap 33, a coupling stub tube 352 radially extended from the coupling ring 351 and connected to one end of the third metal tube 53, and a wire hole 353 through the periphery of the coupling ring 351 in communication with the coupling stub tube 352.

The second coupling 36 comprises a coupling ring 361 mounted around the screw rod 342 of the fourth cap 34 and retained between the central housing 6 and the fourth cap 34, a coupling stub tube 362 radially extended from the coupling ring 361 and connected to one end of the fourth metal tube 53.

The third metal tube 53 has one end coupled to the coupling stub tube 352 of the first coupling 35, and an opposite end coupled to the fifth cap 38.

The fourth metal tube 54 has one end coupled to the coupling stub tube 362 of the-second coupling 36, and an opposite end coupled to the sixth cap 39.

The lamp holder 7 comprises a tubular casing 71, a transverse coupling hole 72 at one end of the tubular casing 71, an annular groove 73 at an opposite end of the tubular casing 71 around the periphery, two separated metal contacts 74 and 75 inside the tubular casing 71, and an ON/OFF switch 76.

The fifth cap 38 comprises an annular cap body 381 covered on the coupling hole 72 of the lamp holder 7 at one end, a coupling stub tube 382 radially extended from the cap body 381 and coupled to one end of the third metal tube 53 at one end opposite to the first coupling 35, and a wire hole (not shown) through the periphery of the cap body 381 in communication with the inside of coupling stub tube 382.

The sixth cap 39 comprises a solid cap body 391 covered on the coupling hole 72 of the lamp holder 7 at one end remote from the fifth cap 38, a screw rod 393 perpendicularly extended from the center of the cap body 391 and inserted through the coupling hole 71 and the fifth cap 38 and then screwed up with the third adjusting screw nut 43, and a coupling stub tube 392 radially extended from the cap body 391 and coupled to one end of the fourth metal tube 54 opposite to the second coupling 36.

The third adjusting screw nut 43 comprises a body 431 having a center screw hole 432 screwed up with the screw rod 393 of the sixth cap 39 to hold down the fifth cap 38, and a finger strip 433 for turning the body 431 on the screw rod 393.

The lampshade 8 comprises a shade body 81, and a mounting socket 82 fastened to the annular groove 73 on the tubular casing 71 of the lamp holder 7 to hold the shade body 81 in place.

The two-line electric wire 9 has one end connected to the metal contacts 74 and 75 through the ON/OFF switch 76 and an opposite end inserted in proper order through the tubular casing 71 of the lamp holder 7, the fifth cap 38, the third metal tube 53, the first coupling 35, the third cap 33, the first metal tube 51, the first cap 31, and the coupling hole 12 of the mounting base 1, and then extended out of the mounting base 1 through the wire hole 13 for connection to an electric power supply outlet. Furthermore, metal packing rings 371, 372, and 372 are respectively mounted around the screw rods 322, 342, and 393, and retained between the mounting base 1 and the first cap 31, the first coupling 35 and the third cap 33, the lamp holder 7 and the fifth cap 38.

It is to be understood that the drawings are designed for purposes of illustration only, and are not intended as a definition of the limits and scope of the invention disclosed.

I claim:

1. A lamp support assembly comprising:

a mounting base, said mounting base comprising a bottom plug rod for connection to a lamp stand, a coupling hole transversely disposed in the middle, a wire hole communicated with the coupling hole of said mounting base, and a lug raised from a top thereof;

a first cap having an annular cap body covered on the coupling hole of said mounting base at one end, a coupling stub tube radially extended from the cap body of said first cap;

a second cap having a solid cap body covered on the coupling hole of said mounting base at one end opposite to said first cap, a screw rod perpendicularly extended from the center of the cap body of said second cap and inserted through the coupling hole of said mounting base and the annular cap body of said first cap, and a coupling stub tube radially extended from the cap body of said second cap;

a first adjusting screw nut screwed up with the screw rod of said second cap to hold down said first cap in position, said first adjusting screw nut having a finger strip radially extended out for turning by hand;

a first metal tube having a first end coupled to the coupling stub tube of said first cap, and a second end;

a second metal tube having a first end coupled to the coupling stub tube of said second cap, and a second end;

a central housing, said central housing comprising a transverse coupling hole and a lug;

a link having a first pivot hole at one end pivotably connected to the lug on said mounting base by a pivot, and a second pivot hole at an opposite end pivotably connected to the lug on said central housing by a pivot;

a third cap having an annular cap body covered on the coupling hole of said central housing at one end, a coupling stub tube radially extended from the cap body of said third cap and coupled to the second end of said first metal tube;

a fourth cap having a solid cap body covered on the coupling hole of said central housing at one end opposite to said third cap, a screw rod perpendicularly extended from the center of the cap body of said fourth cap and inserted through the coupling hole of said central housing and the annular cap body of said third cap, and a coupling stub tube radially extended from the cap body of said fourth cap and coupled to the second end of said second metal tube;

a second adjusting screw nut screwed up with the screw rod of said fourth cap to hold down said third cap in position, said second adjusting screw nut having a finger strip radially extended out for turning by hand;

a first coupling having a coupling ring mounted around the screw rod of said fourth cap and retained between said central housing and said third cap, a coupling stub tube radially extended from the coupling ring of said first coupling;

a second coupling having a coupling ring mounted around the screw rod of said fourth cap and retained between said central housing and said fourth cap, and a coupling stub tube radially extended from the coupling ring of said second coupling;

a third metal tube having a first end coupled to the coupling stub tube of said first coupling, and a second end;

a fourth metal tube having a first end coupled to the coupling stub tube of said second coupling, and a second end;

a lamp holder, said lamp holder comprising a tubular casing, a transverse coupling hole at one end of said tubular casing, an annular groove at an opposite end of said tubular casing around the periphery, two separated metal contacts inside said tubular casing for connection to the two opposite terminals of a lamp;

a fifth cap having an annular cap body covered on the coupling hole of said lamp holder at one end, and a coupling stub tube radially extended from the cap body of said fifth cap and coupled to the second end of said third metal tube;

a sixth cap having a solid cap body covered on the coupling hole of said lamp holder at one end opposite to said fifth cap, a screw rod perpendicularly extended from the center of the cap body of said sixth cap and inserted through the coupling hole on said lamp holder and the annular cap body of said fifth cap, and a coupling stub tube radially extended from the cap body of said six cap and coupled to the second end of said fourth metal tube;

a third adjusting screw nut screwed up with the screw rod of said sixth cap to hold said fifth cap in position, said third adjusting screw nut having a finger strip for turning by hand;

a lampshade having a shade body and a mounting socket fastened to the annular groove on the tubular casing of said lamp holder to hold said shade body in place; and a two-line electric wire having one end connected to the metal contacts inside said lamp holder and an opposite end inserted in proper order through the tubular casing of said lamp holder, said fifth cap, said third metal tube, said first coupling, said third cap, said first metal tube, said first cap, and the coupling hole of said mounting base, and then extended out of the wire hole on said mounting base for connection to an electric power supply outlet.

2. The lamp support assembly of claim 1 further comprising a plurality of metal packing rings respectively mounted around the screw rods of said second cap, said fourth cap and said sixth cap, and respectively retained between said mounting base and said first cap, said first coupling and said third cap, said lamp holder and said fifth cap.

3. The lamp support assembly of claim 1 further comprising an ON/OFF switch mounted on said lamp holder and connected between said metal contacts and said two-line electric wire.

4. The lamp support assembly of claim 1 further comprising an ON/OFF switch mounted on said mounting base and connected between said two-line electric wire and an electric power supply outlet.

* * * * *